US010368656B2

(12) United States Patent
Ergas

(10) Patent No.: US 10,368,656 B2
(45) Date of Patent: Aug. 6, 2019

(54) CRIB PROTECTION APPARATUS

(71) Applicant: Ariel Ruben Ergas, Lakewood, NJ (US)

(72) Inventor: Ariel Ruben Ergas, Lakewood, NJ (US)

( * ) Notice: Subject to any disclaimer, the term of this patent is extended or adjusted under 35 U.S.C. 154(b) by 498 days.

(21) Appl. No.: 15/265,338

(22) Filed: Sep. 14, 2016

(65) Prior Publication Data

US 2018/0070741 A1 Mar. 15, 2018

(51) Int. Cl.

| | |
|---|---|
| ***A47D 7/00*** | (2006.01) |
| ***A47D 15/00*** | (2006.01) |
| ***A47C 29/00*** | (2006.01) |
| ***E04H 15/02*** | (2006.01) |
| ***A47D 9/00*** | (2006.01) |
| ***A47D 13/02*** | (2006.01) |
| *A47C 27/08* | (2006.01) |

(52) U.S. Cl.

CPC ..... *A47D 15/008* (2013.01); *A47D 7/00* (2013.01); *A47C 27/08* (2013.01); *A47C 29/00* (2013.01); *A47D 15/00* (2013.01); *E04H 15/02* (2013.01)

(58) Field of Classification Search

CPC .... A47D 15/00; A47D 15/008; A47D 15/005; A47D 7/00; A47D 7/002; A47D 7/007; A47D 7/01; A47D 7/02; A47D 7/10; A47D 9/00; A47D 9/005; A47D 13/02; A47D 13/06; A47D 13/061; A47D 13/065; A47D 13/066; A47C 29/00; A47C 29/003; A47C 27/08; E04H 15/02; E04H 15/04; E04H 15/42; A61G 11/00

See application file for complete search history.

(56) References Cited

U.S. PATENT DOCUMENTS

| | | | | | |
|---|---|---|---|---|---|
| 1,594,256 | A * | 7/1926 | Greene | A47C 29/006 | 5/296 |
| 2,681,659 | A * | 6/1954 | Hrinsin | A47C 29/003 | 135/119 |
| 2,820,468 | A * | 1/1958 | Park | A47C 29/003 | 135/115 |
| 3,878,570 | A * | 4/1975 | Donnelly | A47D 15/00 | 219/217 |
| 4,945,584 | A * | 8/1990 | LaMantia | A47C 29/003 | 135/127 |
| 5,099,866 | A * | 3/1992 | Solis | A47C 29/003 | 135/117 |
| 5,259,408 | A * | 11/1993 | Guerin | A47C 29/006 | 135/147 |
| 5,517,707 | A * | 5/1996 | LaMantia | A47C 29/003 | 135/96 |
| 5,862,548 | A * | 1/1999 | Gerhart | A47D 13/06 | 135/117 |
| 6,098,218 | A * | 8/2000 | Ventura | A47C 29/006 | 135/91 |

(Continued)

*Primary Examiner* — Nicholas F Polito
*Assistant Examiner* — Rahib T Zaman
(74) *Attorney, Agent, or Firm* — Dunlap Bennett & Ludwig PLLC; Brendan E. Squire

(57) ABSTRACT

An apparatus for controlling access to a crib includes a plurality of panels having spaced apart rungs. A front frame has an upper and a lower panel that are hingedly connected to the frame for providing access to a sleeping area of the crib. The crib roof provides a universal fit for conventional and extended length cribs.

15 Claims, 4 Drawing Sheets

(56) References Cited

U.S. PATENT DOCUMENTS

| | | | | |
|---|---|---|---|---|
| 6,263,894 | B1 * | 7/2001 | LaMantia | A47C 29/006 135/117 |
| 6,487,735 | B1 * | 12/2002 | Jacques, II | A47D 7/02 5/424 |
| 6,500,111 | B1 * | 12/2002 | Salmon | A61G 10/005 600/22 |
| 6,550,083 | B1 * | 4/2003 | LaMantia | A47C 29/003 135/96 |
| 6,644,329 | B2 * | 11/2003 | Tomason | E04H 15/02 135/90 |
| 7,047,991 | B2 * | 5/2006 | Kline | A47C 21/08 135/96 |
| 7,150,052 | B1 * | 12/2006 | Lawson | A47C 29/003 5/97 |
| 7,322,315 | B2 * | 1/2008 | Brewer | A01K 1/033 119/474 |
| 7,673,353 | B1 * | 3/2010 | Khodabandeh | A47C 29/003 5/284 |
| 2004/0099301 | A1 * | 5/2004 | Zhang | A47C 29/006 135/135 |
| 2012/0117726 | A1 * | 5/2012 | LaMantia | A47C 29/003 5/97 |
| 2013/0291918 | A1 * | 11/2013 | Lovell | A47C 29/003 135/151 |
| 2014/0208504 | A1 * | 7/2014 | Do | A47D 7/002 5/99.1 |

* cited by examiner

CRIB PROTECTION APPARATUS

BACKGROUND OF THE INVENTION

The present invention relates to child sleep cribs, and more particularly to apparatus for protecting children while contained within a crib.

Cribs have long been utilized for infant and child sleeping. For infants, the crib presents few safety concerns because the infant is relatively immobile. However, as the child grows and becomes mobile, a conventional crib can become a hazard, particularly when they are beginning learn to stand, and later, climb.

As the child begins to develop these skills, the crib presents new hazards. The child's discovery of the adventure of climbing, combined with the desire to get out of the crib to be with loved ones encourages the child to want to climb out of the crib. While the child may quickly develop the rudimentary skills of climbing sufficient to get over the railing, they lack the necessary skills to safely reach the floor. Accordingly, they may either get stuck, hanging from the cribs railing or fall to the ground below. In either case, the crib presents a significant safety hazard due to hanging or falling.

As can be seen, there is a need for a system that eliminates hazards of a child climbing from a crib.

SUMMARY OF THE INVENTION

In one aspect of the present invention, an apparatus for controlling access to a crib, includes: a rear panel having a top and a bottom longitudinal member, a left and a right vertical member, and a plurality of spaced apart rungs extending between the top and the bottom longitudinal frame members; a front frame having a top and a bottom longitudinal frame member and a left and a right vertical frame member, wherein the top longitudinal frame member is attached to the top longitudinal member of the rear panel to configure the front frame and rear panel in a generally A-shaped structure; an upper panel having a top and a bottom longitudinal member and a plurality of spaced apart rungs extending between the top and the bottom longitudinal member, wherein the top longitudinal member of the upper panel is attached to the top longitudinal frame member; a lower panel having a top and a bottom longitudinal member and a plurality of spaced apart rungs extending between the top and the bottom longitudinal member, wherein the top longitudinal member of the lower panel is attached to the bottom longitudinal member of the upper panel; and a plurality of rods extending between the left and the right vertical frame members of the front frame and the left and the right vertical frame members of the rear panel. In certain embodiments, the apparatus may have a hinge attaching the rear panel and the front frame. A hinge may also attach the upper panel to the front frame. Yet another hinge may attach the lower panel to the upper panel.

In certain preferred embodiments, a latching mechanism is operable to secure the lower panel to the front frame. The latching mechanism may further include a post and a socket aperture, wherein at least one pawl, carried by the post, is biased in a latching position and is operable between the latching position and an opening position. The crib roof may also include a plurality of frame plates attached to and extending downwardly from the front frame and the rear panel.

In yet other aspects of the invention an attachment mechanism is configured to join the lower longitudinal frame members of the rear panel and the front frame with a top longitudinal rail of a crib. In some embodiments, the attachment mechanism is a clamp and in others the attachment mechanism is a tie.

In yet other aspects of the invention, an apparatus for controlling access to a crib, includes a generally A-shaped structure formed from the hinged connection of a rear panel and a front frame; a top end of an upper panel pivotally attached to a top end of the structure; a top end of lower panel pivotally attached to a bottom end of the upper panel, wherein the lower panel and the upper panel are moveable between a closed position covering an access opening of the front frame and an open position providing access to the access opening of the front frame; and a plurality of spaced apart rods extending between the rear panel and the front frame at a first and a second end of the A-shaped structure.

The crib roof may also include a plurality of frame plates that extend from a bottom end of the A-shaped structure. The frame plates are configured to engage with an inner face of a top frame rail of a crib. A latching mechanism may also be provided for releasably securing the lower panel to the front frame. A clamp may be configured to attach a lower portion of the A-shaped structure to the top frame rail of the crib. In other embodiments, a tie is configured to attach a lower portion of the A-shaped structure to the top frame rail of the crib.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an apparatus for containing a child within a crib to eliminate the hazards presented by a child climbing out of a crib.

Figure 1:
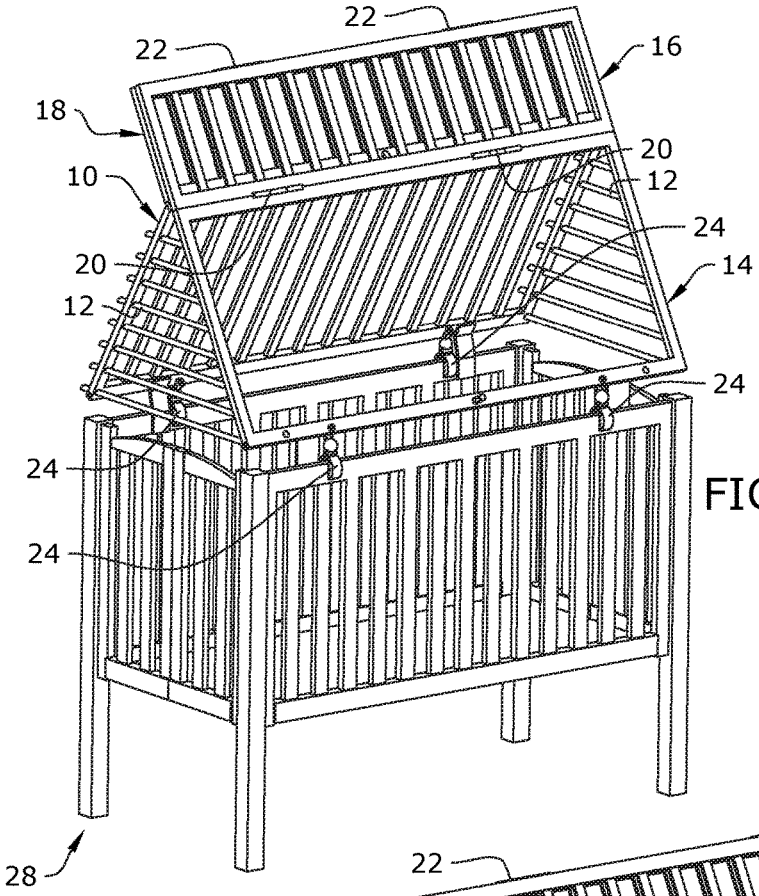
FIG. 1 is a perspective view of an embodiment of a crib roof in use and in an open condition.

As seen in reference to FIG. 1, a crib roof according to an embodiment of the invention is applied to a conventional sized crib 28. A crib roof according to other aspects of the invention may also be applied to an extended size crib 30 as illustrated in reference to FIG. 9. The crib roof includes a rear panel 10, a front frame 14, an upper folding panel 16, and a lower folding panel 18. The rear panel 10, upper 16 and lower 18 folding panels are formed as elongate, substantially rectangular frames having opposed longitudinal frame members and opposed vertical frame members. A plurality of rungs are disposed in a spaced apart relation between the longitudinal frame members of the respective panels. The spacing between the rungs should be consistent with those required in the crib.

Figure 2:
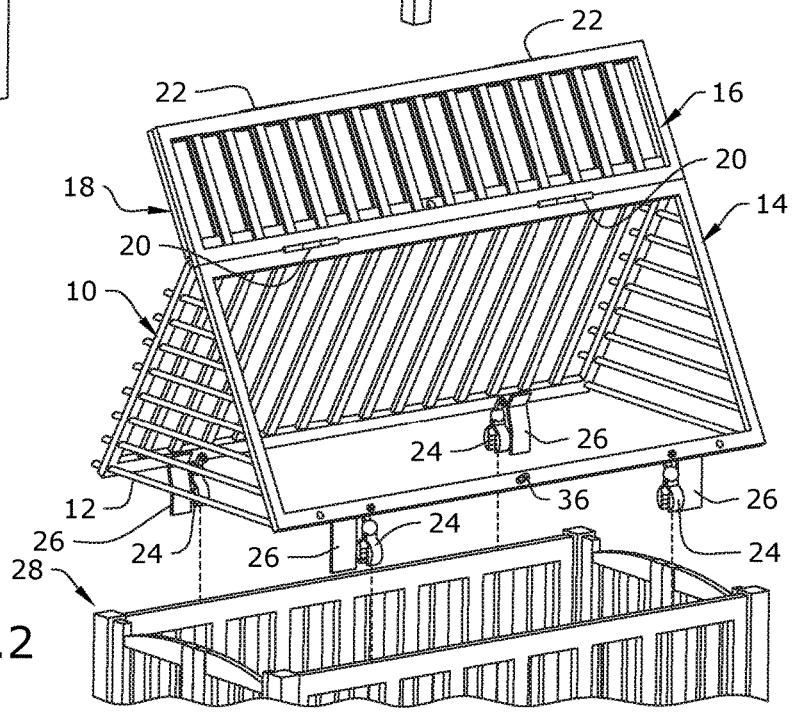
FIG. 2 is an exploded view of a crib roof.

The rear panel 10 and the front frame 14 are attached to one another along a longitudinal length of their respective top longitudinal frame members to form a generally A-shaped structure. The upper folding panel 16 is attached to the top of the front frame 14 via a hinge 20. A top edge of the lower folding panel 18 is attached to a bottom edge of the upper folding panel 16. As seen in reference to FIGS. 2 and 3, the upper 16 and lower 18 folding panels are configured to articulate about hinges 20 and 22 to provide an opening access to a crib sleeping area, so as to provide unimpeded access to the area.

A plurality of rods 12 are attached in a spaced apart relation between the inward facing surfaces of the front frame 14 and the rear panel 10 to form a side closure between the legs of the A-shaped structure. The rods 12 may be received in a frictional engagement with a plurality of bores defined in the inward facing surfaces of the front frame 14. Preferably, the rods 12 are threadingly received in the inward facing surface of the bores in the front frame, to permit assembly and disassembly of the side closures and the crib tent.

Figure 4:
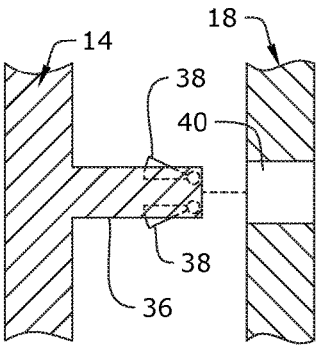
FIG. 4 is a sectional view of a post latch according to aspects of the invention.
Figure 3:
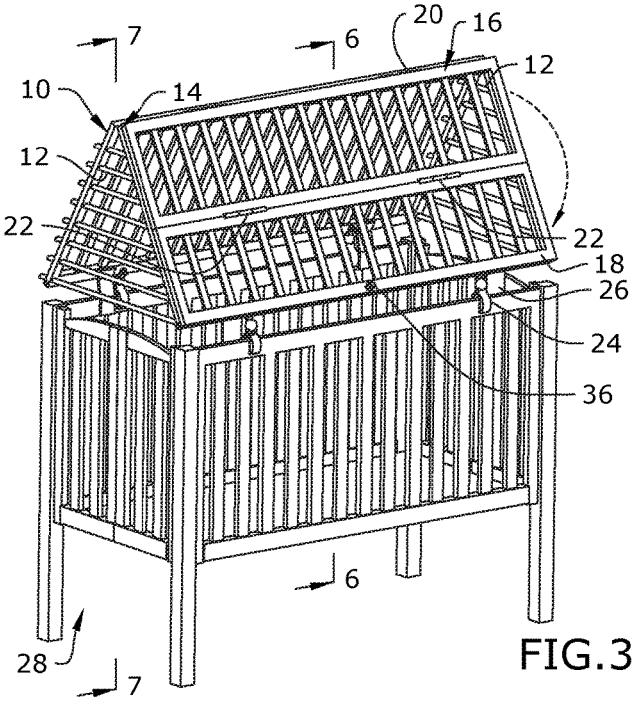
FIG. 3 is a perspective view of a crib roof in use and in a closed condition.
Figure 5:
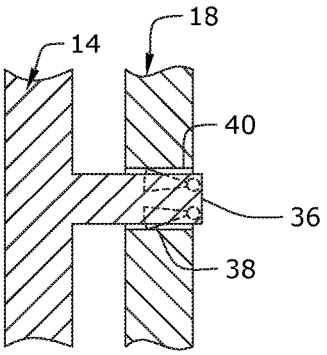
FIG. 5 is a sectional view demonstrating the post latch.
Figure 6:
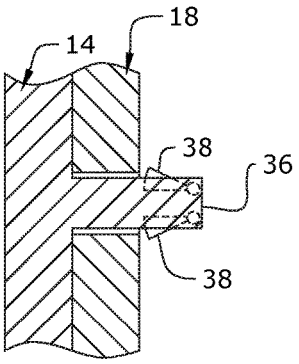
FIG. 6 is a detail sectional view taken along line 6-6 of FIG. 3.
Figure 7:
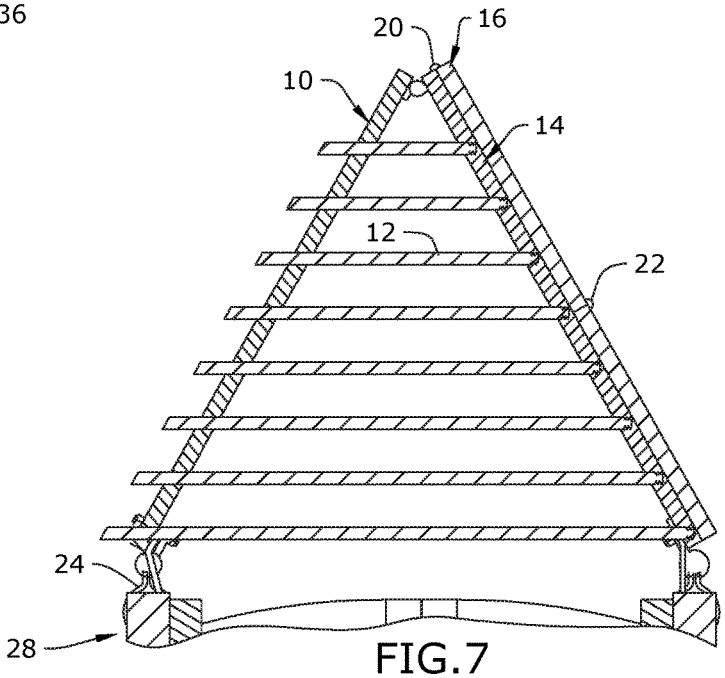
FIG. 7 is a sectional view of the crib roof taken along line 7-7 of FIG. 3.

The panels 16 and 18 may be are operable between the open configuration depicted in FIGS. 1 and 3 and a closed configuration depicted in reference to FIG. 3. In the open position, the panels 16 and 18 may be temporarily secured by extension against hinges 20. In the closed position, the panels 16 and 18 are hinged downwardly to and rest against a surface of the front frame 14. In certain embodiments, the crib roof may also include a latch mechanism to secure the lower panel against the front frame 14. The latch mechanism may include a post and socket configuration shown in reference to FIGS. 4-6. The post 36 may extend from a front surface of the lower frame member of the front frame 14. A socket aperture 40 is defined in a lower longitudinal frame member of the lower panel 18. The post 36 includes at least one pawl 38, or wing that is received within a slot at an end portion of the post 36. Preferably, the pawl 38 is biased so that it extends outwardly in a latching position and is operable between the latching position and an opening position. In the latching position, depicted in FIG. 6, the pawls extend outwardly and engage with an outer surface of the lower frame member surrounding the socket aperture 40. In the opening position, the pawl 38 is at least partially retracted in the slot so that the pawl 38 and post 36 may be withdrawn from the socket aperture 40 and permit freedom of movement to the lower panel 18 and the upper panel 16.

A plurality of frame plates 36 may extend from a lower surface of the crib roof to engage with an inner surface of the top frame rails of the crib 28. The frame plates 36 are configured to align and maintain the crib roof in position over the crib 28. The frame plates 36 are urged outwardly against the top frame rails of the crib 28 by the weight of the frame and the ability of the rear panel 10 and the front frame 14 to articulate about hinge 15.

As seen in reference to FIGS. 1, 2, 3, and 7, in some embodiments, the crib tent is attached to the crib 28 via a plurality of clamps 24. Preferably, the clamps 24 are attached to the lower longitudinal frame members of the back panel 10 and the front frame 14 and have jaw openings that are operable to clamp a top frame rail of the crib 28.

Figure 8:
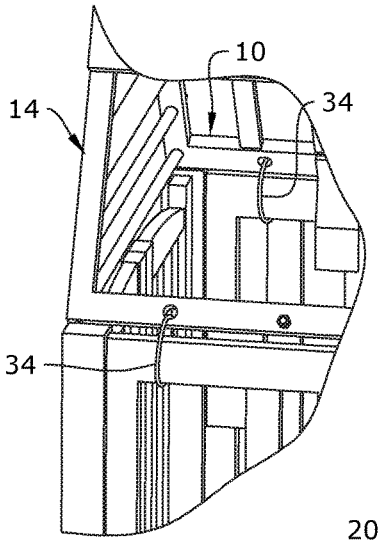
FIG. 8 is a detail view illustrating a tie attachment method.

As seen in reference to the detail view of FIG. 8, in some embodiments, the crib roof may be secured to the top frame rails of the crib 28 via a plurality of ties 34, such as a tie-wrap, a length of string, rope, leather or other suitable material. The ties 34 may be received around the longitudinal frame members and may alternatively be received through an aperture defined in one or more of the longitudinal frame members of the back panel 10, the front frame 14, or the top frame rails of the crib 28.

Figure 9:
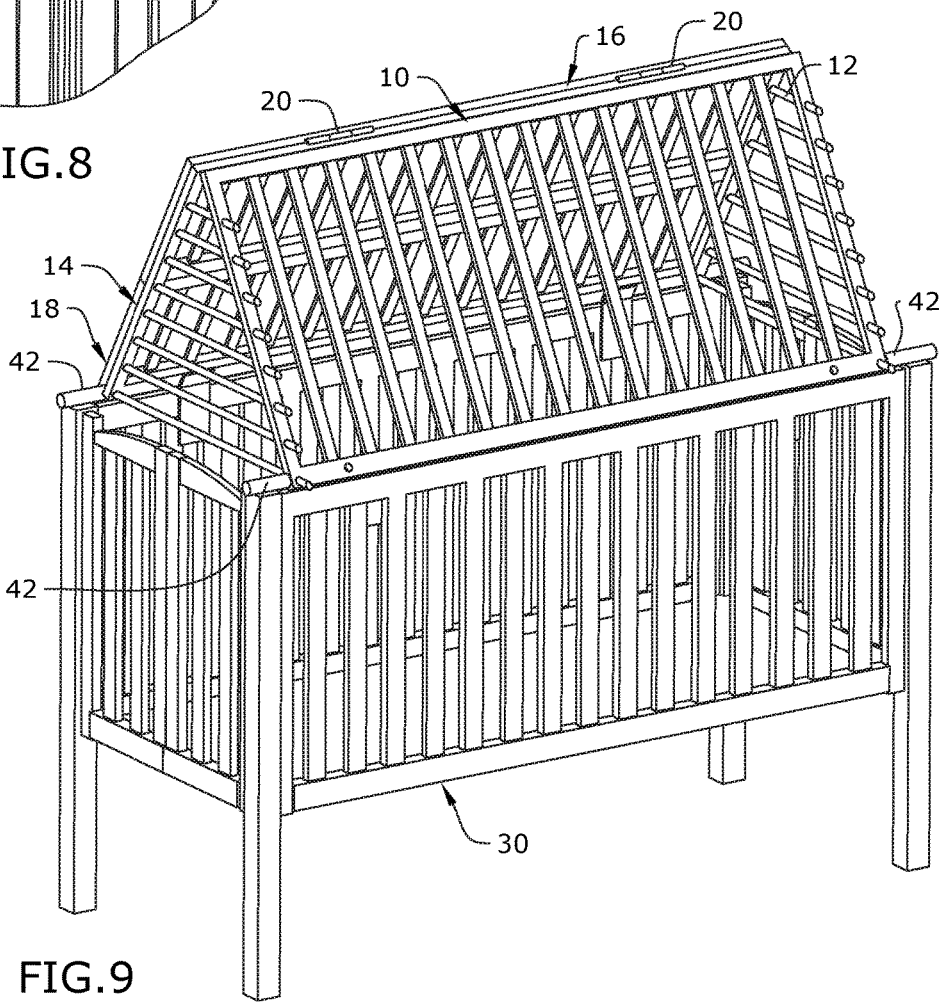
FIG. 9 is a perspective view illustrating a side extension usage.

As seen in reference to FIG. 9, some embodiments of the crib roof may also include an adapter to accommodate fitting the crib roof to an extended length crib 30. The adapter may include a dowel 42 extending from an end of the lower longitudinal support members and generally aligned with the same. The dowels 42 extend by a length so that they may be supported on top of a corner post of the extended length crib 30.

Figure 10:
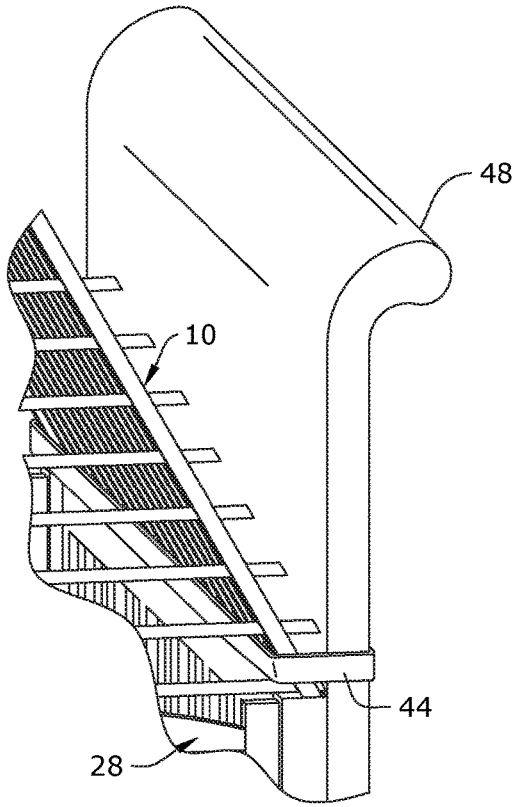
FIG. 10 is a side perspective view illustrating a strap usage.
Figure 11:
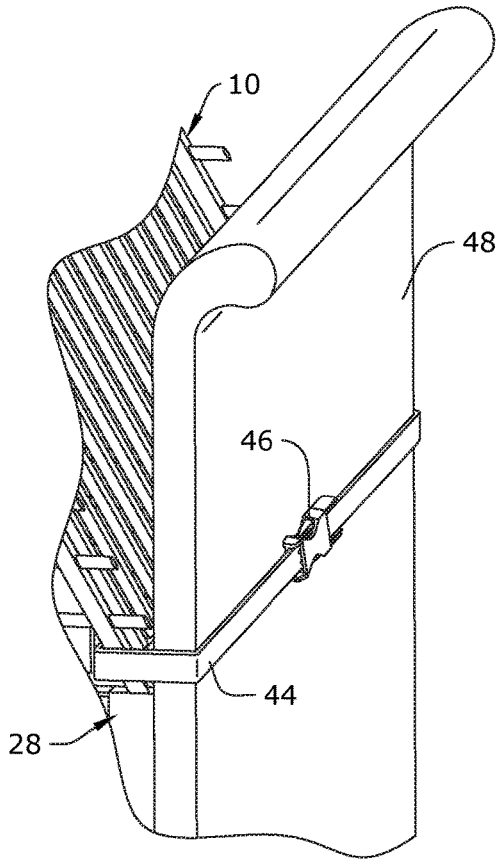
FIG. 11 is a rear perspective view illustrating a strap usage.

In yet another embodiment, shown in reference to FIGS. 10 and 11, the crib roof 10 may be secured to the crib headboard 48 via a strap 44. The strap 44 may be utilized to secure the crib roof may to the top frame rails of the crib 28. The strap 44 may be received around the longitudinal frame members of the crib roof. The straps 44 are a preferred means of securing the crib roof to a crib, where the headboard 48 and rails of the crib 28 have a dissimilar height above a floor surface. With these designs of cribs 28, the crib post at aft end of the headboard will be higher than a crib post forward end of the crib. Straps 44 are also a preferred securing means where the crib rails are too wide for the clamp 24, discussed above.

As will be appreciated, the crib roof according to the various aspects of the present invention is universally configurable to adapt to almost any available crib. It should be understood, of course, that the foregoing relates to exemplary embodiments of the invention and that modifications may be made without departing from the spirit and scope of the invention as set forth in the following claims.

What is claimed is:

1. An apparatus for controlling access to a crib, comprising:

a rear panel having a top and a bottom longitudinal member, a left and a right vertical member, and a plurality of spaced apart rungs extending between the top and the bottom longitudinal frame members;

a front frame having a top and a bottom longitudinal frame member and a left and a right vertical frame member, wherein the top longitudinal frame member is attached to the top longitudinal member of the rear panel to configure the front frame and rear panel in a generally A shaped structure;

an upper panel having a top and a bottom longitudinal member and a plurality of spaced apart rungs extending between the top and the bottom longitudinal member, wherein the top longitudinal member of the upper panel is attached to the top longitudinal frame member;

a lower panel having a top and a bottom longitudinal member and a plurality of spaced apart rungs extending between the top and the bottom longitudinal member, wherein the top longitudinal member of the lower panel is attached to the bottom longitudinal member of the upper panel; and a plurality of rods extending between the left and the right vertical frame members of the front frame and the left and the right vertical frame members of the rear panel.

2. The apparatus of claim 1, further comprising:

a hinge attaching the rear panel and the front frame.

3. The apparatus of claim 2, further comprising:

a hinge attaching the upper panel to the front frame.

4. The apparatus of claim 3, further comprising:

a hinge attaching the lower panel to the upper panel.

5. The apparatus of claim 4, further comprising:

a latching mechanism operable to secure the lower panel to the front frame.

6. The apparatus of claim 5, wherein the latching mechanism further comprises:

a post and a socket aperture, wherein at least one pawl is biased in a latching position and is operable between the latching position and an opening position.

7. The apparatus of claim 2, further comprising:

a plurality of frame plates attached to and extending downwardly from the front frame and the rear panel.

8. The apparatus of claim 7, further comprising:

an attachment mechanism configured to join the lower longitudinal frame members of the rear panel and the front frame with a top longitudinal rail of a crib.

9. The apparatus of claim 8, wherein the attachment mechanism is a clamp.

10. The apparatus of claim 8, wherein the attachment mechanism is a tie.

11. An apparatus for controlling access to a crib, comprising:

a generally A-shaped structure formed from the hinged connection of a rear panel and a front frame;

a top end of an upper panel pivotally attached to a top end of the structure;

a top end of lower panel pivotally attached to a bottom end of the upper panel, wherein the lower panel and the upper panel are moveable between a closed position covering an access opening of the front frame and an open position providing access to the access opening of the front frame; and a plurality of spaced apart rods extending between the rear panel and the front frame at a first and a second end of the A-shaped structure.

12. The apparatus of claim 11, further comprising:

a plurality of frame plates extending from a bottom end of the A-shaped structure, the frame plates configured to engage with an inner face of a top frame rail of a crib.

13. The apparatus of claim 12, further comprising:

a latching mechanism for releasably securing the lower panel to the front frame.

14. The apparatus of claim 13, further comprising:

a clamp configured to attach a lower portion of the A-shaped structure to the top frame rail of the crib.

15. The apparatus of claim 13, further comprising:

a tie configured to attach a lower portion of the A-shaped structure to the top frame rail of the crib.

* * * * *